United States Patent [19]

Löf

[11] Patent Number: 5,009,274

[45] Date of Patent: Apr. 23, 1991

[54] LATERALLY ADJUSTABLE DRILLING TOOL

[75] Inventor: Stig U. Löf, Sunne, Sweden

[73] Assignee: Uniroc Aktiebolag, Fagersta, Sweden

[21] Appl. No.: 503,724

[22] Filed: Apr. 3, 1990

[30] Foreign Application Priority Data

Apr. 5, 1989 [SE] Sweden ..... 8901198

[51] Int. Cl.[5] ..... E21B 10/66

[52] U.S. Cl. ..... 175/260; 175/284; 175/384; 175/398

[58] Field of Search ..... 175/257-263, 175/273, 284, 292, 384, 385, 389, 398, 414, 320, 322, 323, 171, 399; 408/150

[56] References Cited

U.S. PATENT DOCUMENTS

| | | | |
|---|---|---|---|
| 3,416,616 | 12/1968 | Ahlgren | 175/399 X |
| 4,408,669 | 10/1983 | Wiredal | 175/258 |
| 4,545,443 | 10/1985 | Wiredal | 175/258 |
| 4,591,010 | 5/1986 | Persson | 175/320 |
| 4,620,600 | 11/1986 | Persson | 175/73 |
| 4,770,259 | 9/1988 | Jansson | 175/258 |

FOREIGN PATENT DOCUMENTS 263088 4/1988 European Pat. Off. .

*Primary Examiner*—Ramon S. Britts
*Assistant Examiner*—Terry Lee Melius
*Attorney, Agent, or Firm*—Eric Y. Munson; Mark P. Stone

[57] ABSTRACT

A drilling tool is followed by a casing tube (11) down the drilled hole. The mouth of the casing tube (11) centers rotatably a guide member (10) which receives rotation and impact energy via the interior of the casing tube (11). A drill bit (20) consists integrally of an axially protruding pilot portion (23), a sidewise projecting eccentric portion (22) and a rear shaft (21). The shaft (21) extends pivotally and axially movably into an eccentrically disposed bore (24) in the guide member (10). Axially spaced peripheral end grooves (30,32) extend in opposite direction from an axial cam groove (31) on the shaft (21) and are engaged by a follower (28) in the guide member (10) defining positively the axial and angular movability and positions thereof relative to the drill bit (20). In the forward end groove (32) the follower (28) maintains the drill bit (20) axially in drilling position (FIG. 2) adjacent to the guide member (10) with the eccentric portion (22) protruding to drill a hole larger than the casing tube (11). In an intermediate position 90° away from the drilling position, the follower (28) enters the cam groove (31) whereby the guide member (10) becomes axially movable the distance between the end grooves (30,32). In a rear axial position the guide member (10) by a continued 90° turn brings the follower (28) into the rear end groove (30) to axially define the retracted position (FIG. 1) of the drill bit (20), wherein it can be raised or lowered freely through the casing tube (11).

10 Claims, 2 Drawing Sheets

LATERALLY ADJUSTABLE DRILLING TOOL

The present invention relates to a drilling tool for drilling in earth and in rock covered by overburden concurrently with a casing tube following the drilling tool downhole, in particular of the type incorporating a guide member rotatably centered in said casing tube at the mouth thereof, a drill bit having a shaft integral with an intermediate laterally projecting eccentric bit and an axially protruding frontal pilot bit, said shaft being journalled in an eccentrically disposed bore in said guide member to move relative thereto pivotally and axially between, on the one hand, a drilling position wherein the pilot bit is coaxial with the guide member and the eccentric bit projects laterally beyond the casing tube so as to drill a hole larger than said casing tube, and, on the other hand, a retracted position in which the drill bit can be retracted or lowered through the casing tube.

A drilling tool of the above type is disclosed in EP Pat. application No. 87850287.1, publication No. 0 263 088 A2. During drilling with such drilling tools in stony ground or fissured rock the drill bit occasionally tends to get wedged so that one runs the risk of losing the tool. The problem is that the guide member is hindered from rotating around the eccentric shaft of the stuck drill bit. During reverse rotation the threads of the drill string tend to open without one being able to bring the drill bit into retracted position so as to be raised through the casing tube. Another difficulty arises when the casing tube is wedged stuck and the drilling tool fails to push up the mouth of the casing tube from below with sufficient power to free the tube.

It is an object of the invention to improve in the above type of drilling tools the remedial characteristics of the tool when becoming stuck and simultaneously to assure an improved operability thereof in its drilling as well as retracted positions. These objects are attained by the characterizing features of the appended claims.

An embodiment of the invention is described hereinafter with reference to the enclosed drawings, wherein FIG. 1 shows in cross section passage of the guide member through the casing tube with the drill bit, shown in shown view, hanging down therefrom in retracted position.

Figure 1:
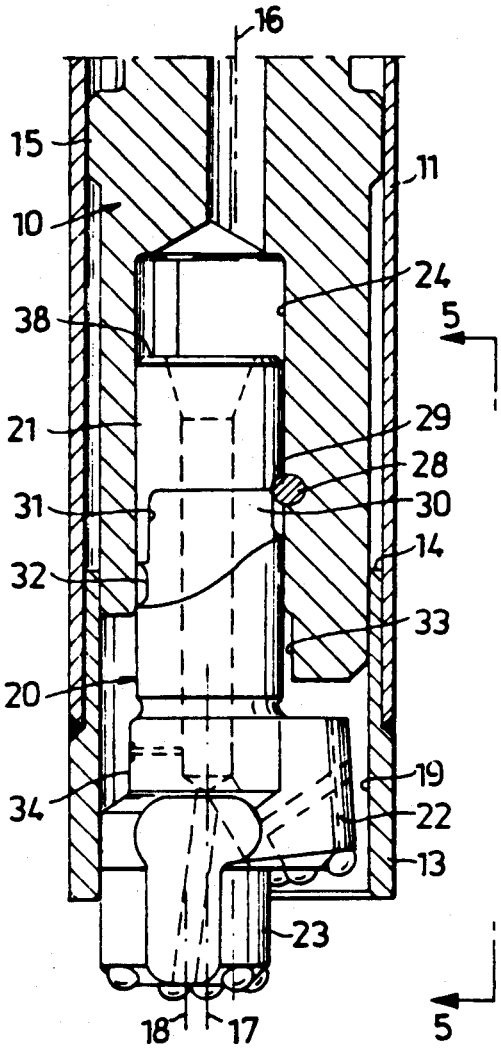

The guide member 10 is in the usual way coupled to a drill string extending through the casing tube 11. In the example shown the drill string rotates the guide member 10 in the clockwise direction when viewed from above and delivers impact energy thereto from a tophammer above ground or from a downhole drill coupled in impact generating position between the drill string and the guide member 10. The drill string and the parts associated therewith are conventional and not shown in the drawings.

The guide member 10 has a circularly cylindrical guide portion 12 which with a centering fit is guided by the mouth of the casing tube 11 for rotation coaxially with the drilling axis 16. In the example shown illustrating drive by a down-the-hole drill, the mouth of the casing tube has welded thereon a guide shoe 13, which provides an internal shoulder 14 in the casing tube and a circularly cylindrical guide opening for the guide portion 12. The guide member 10 has axial abutments at the rear thereon abutting on the shoulder 14 whereby part of the impact power from the downhole drill is transmitted to drive down the casing tube 11, FIG. 2.

The drill bit 20 incorporates a rear shaft 21 in one piece with an eccentric portion or bit 22 and a pilot bit 23. The shaft 21 is pivotally journalled in the guide member 10 in and around the axis 17 of an eccentric bore 24 extending in laterally spaced and parallel relation to the drilling axis 16. The pilot bit 23 in its turn is centered on an axis 18 which is parallel with the axes 16,17 but has the double lateral spacing to the drilling axis 16 when compared to the shaft axis 17.

When the drill bit 20 takes an angular position in the bore 24 with the pilot bit axis 18 at such maximal distance from the drilling axis 16, FIG. 1, both the pilot bit 23 at one side of the shaft axis 17 and the eccentric bit at the opposite side thereof are directed such that both bits fall within the outer contour of the cylindrical guide portion 12 and thus can pass freely through the guide opening 19 of the guide shoe 13 as shown in FIG. 1.

When the drill bit is turned about 180 degrees from the aforementioned position the axes 16,18 coincide. The pilot bit thus becomes coaxial with the drilling axis 16 and the eccentric bit is projected laterally sufficiently beyond the outer contour of the guide shoe 13 so as to be able to drill a hole larger than the casing tube 11. Such position is illustrated in FIG. 2.

In the radially retracted position of FIG. 1 the drill bit 20 hangs freely in the guide member 10, being retained axially form-bound thereto by follower means such as a cam follower 28. In the example shown the cam follower is a pin 28 inserted in a transverse bore in the guide member 10 and projecting into the bore 24 for cooperation with an arresting groove 29 in the rear shaft 21. With the drill bit 20 hanging freely in retracted position, the pin 28 will engage the arresting groove 29 and is thereby kept bidirectionally arrested form-bound against rotation relative to the guide member 10 so as to be able to pass safely through the casing tube The arresting groove 29 opens from behind into a peripheral rear end groove 30 in the shaft 21. When the drill bit 20 meets the surface to be drilled, the cam follower 28 enters the end groove 30. The latter allows an angular form-restricted movement of about 90 degrees to be performed by the guide member 10 relative to the drill bit 20 clockwise in the drill rotating direction until the cam follower 28 reaches a forwardly directed cam groove 31. Therein the cam follower 28 is allowed to move axially in forward direction until met by a peripheral forward end groove 32. Continued rotation in the drill rotating direction of the guide member 10 some further 90 degrees locks the cam follower 28 form-bound in axial direction in and by the forward end groove 32 as shown in FIG. 2. The illustrated helical surface shown opposite to the straight one of cam groove 31 is generated when said groove is milled by a cylindrical tool and comes in helpful for guiding the complex movement of the drill bit 20.

Figure 2:
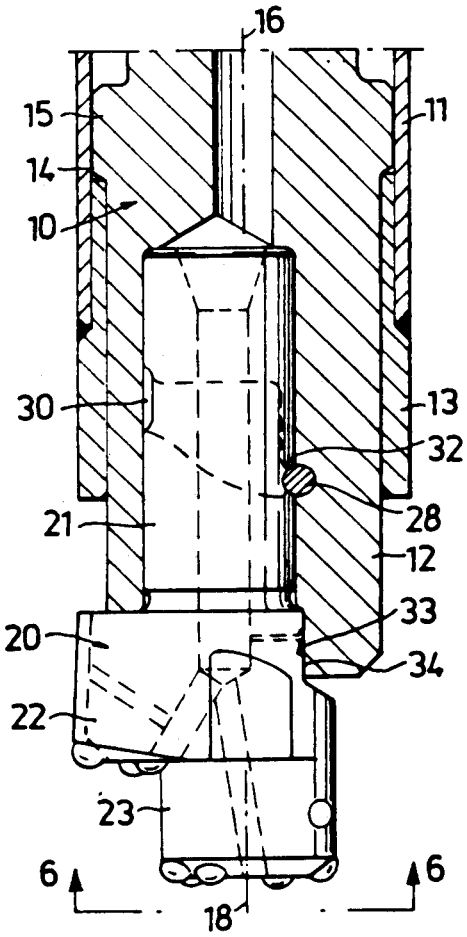
FIG. 2 shows a corresponding view with the drill bit in drilling position adjacent to the guide member which is supported in the casing shoe at the mouth of the casing tube.
Figure 3:
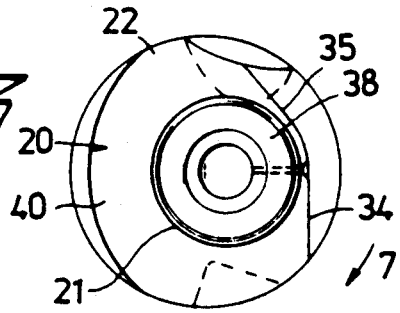
FIG. 3 is a rear end view of the drill bit in FIG. 2.
Figure 4:
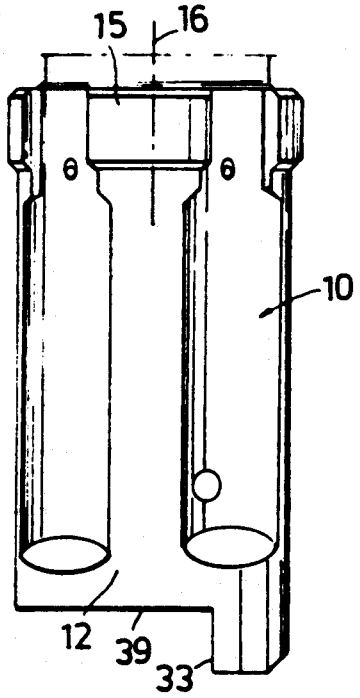
FIG. 4 is a side view of the guide member in FIG. 2.
Figure 5:
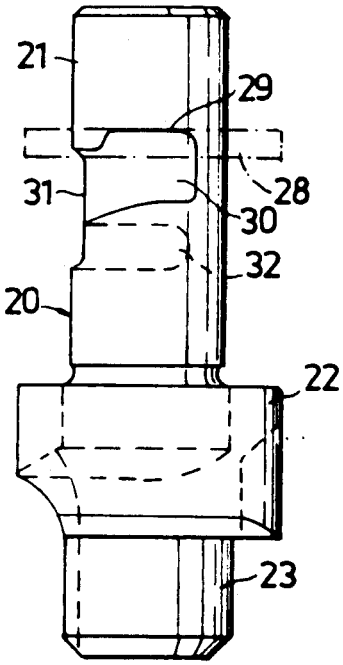
FIG. 5 is a side view of the bit in FIG. 1 seen in the direction of arrows 5—5.

The position in FIG. 2 is the drilling position of the drill bit 20. The shoulder 14 of guide shoe 13 or (when tophammer drilling is practiced, and the guide member 10 is centered by the interior of the casing tube 11 itself) the predetermined bound axial relationship between the drill string and the casing tube 11 has to define such an exposure of the guide portion 12 in front of the forward edge of the casing shoe 13 or casing tube 11 that the distance therebetween and between back 40 of the eccentric bit 22 approximately will be equal to or somewhat larger than the length of the pilot bit 23. A stuck casing tube will thus be unable to prevent lifting of the pilot bit 23 from its leading hole and the drill bit 20 is then free to be turned into the retracted position. During the peripheral and axial relative movement of the drill bit 20 from the position in FIG. 1 the cam grooves 30–32 and the pin 28 function as cooperating cam and follower means whereby the drill bit is guided and is in the drilling position of FIG. 2 brought adjacent to and in front of an axially protruding shoulder 33 on the guide member 20. During drilling the shoulder 33 abuts against a mating transverse abutment 34, shown in FIG. 3, and transmits drilling rotation (arrow 7) to the drill bit 20 simultaneously with pressing the cam follower 28 into and locking it in the forward end groove 32. In the drilling position of FIG. 2 the end 38 of shaft 21 is in engagement with the bottom of bore 24 and concurrently therewith the axial face 39 of the guide member also trans- mits impact power to the back 40 of the eccentric bit 22.

The form-bound guidance of the drill bit 20 allows, due to the axial movability of the follower 28 in cam groove 31, that powerful blows by cam follower 28 can be directed upward against the rear cam groove 30 in order to hammer free a stuck drill bit 20. The pivotal movement and a rounded surface at 35 on the abutment 34, FIG. 3, allows turning movement of the guide member 10 to bring follower 28 into axially movable position even with the drill bit stuck, notwithstanding that the shaft 21 then takes eccentric position. Incidentally, in this and in the locked drilling position the casing tube 11 can be knocked upward from a jammed position by means of back 40 (FIG. 3) of the drill bit 20. Repeated short raising of the drill bit 20 in its drilling position and subsequent blowing eases cleaning of the working surface and of the forward portion of the drill bit 20 from clay. Positioning of the drill bit 20 in a retracted fixed angular position above a hindering stone edge allows crushing or knocking aside of the stone by blows without drill rotation so that drilling then can be continued the normal way.

Figure 6:
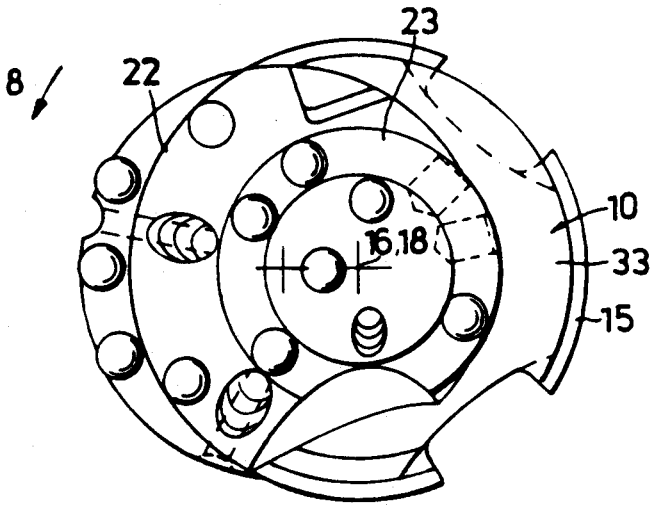
FIG. 6 is a somewhat enlarged end view of the drill bit and guide member in FIG. 2 seen in the direction of arrows 6—6.

The drilling tool preferably drills by means of hard metal buttons fitted on the front surfaces of the pilot and eccentric bits 23,22. The arrangement of the buttons is optional for this invention, one preferred arrangement being indicated in FIG. 6.

I claim:

1. A drilling tool for drilling in earth and in rock covered by overburden concurrently with a casing tube (11) following the drilling tool downhole, said tool incorporating a guide member (10) rotatably centered in said casing tube (11) at the mouth thereof, a drill bit (20) having a shaft (21) integral with an intermediate laterally projecting eccentric bit (22) and an axially protruding frontal pilot bit (23), said shaft (21) being journalled in an eccentrically disposed bore (24) in said guide member (10) to move relative thereto pivotally and axially between, on the one hand, a drilling position wherein the pilot bit (23) is coaxial with the guide member (10) and the eccentric bit (22) projects laterally beyond the casing tube (11) so as to drill a hole larger than said casing tube (11), and, on the other hand, a retracted position in which the drill bit (20) can be retracted and lowered through the casing tube (11), said drilling tool being c h a r a c t e r i s e d b y cooperating cam and follower means (30,31,32;28) between said shaft (21) and said guide member (10) wherein:

(a) the drill bit (20) is maintained in the drilling position thereof form-bound adjacent to the guide member (10) so as to be movable in axial direction in unison therewith, (b) the guide member (10) by a form-restricted angular displacement relative to the drill bit (20) away from said drilling position is freed to perform a form-restricted axial movement backward and forward relative to the drill bit (20), and (c) the guide member (10) in said backward position thereof by a form-restricted continued angular displacement relative to the drill bit (20) away from said drilling position is again maintained form-bound to the drill bit (20) for axial movement in unison therewith with the drill bit (20) in retracted position spaced in front of the guide member (10).

2. A drilling tool according to claim 1 wherein the total angular displacement of the guide member (10) relative to the drill bit (20) is substantially 180 degrees.

3. A drilling tool according to claim 1, wherein said cam means are cam grooves (30–32) on said shaft (21) comprising an axial groove (31) extending between peripherally disposed rear end forward end groove (30,32), the follower means being a cam follower (28) in said guide member (10) in cooperating engagement with said said cam grooves (30–32).

4. A drilling tool according to claim 3, wherein the drill bit (20), when pivoted to the retracted position thereof and hanging on the guide member (10), is non-rotatably locked to the guide member (10) by said cam follower (28) falling into an arresting groove (29) that opens from the rear into the rear end groove (30).

5. A drilling tool according to claim 3, wherein said cam follower (28) is a pin transversely disposed in said guide member (10) and extending into said bore (24) thereof for cooperation with said cam grooves (29–32) on said drill bit (20).

6. A drilling tool according to claim 1, wherein the eccentric bit (22) in its drilling position is maintained by said cam and follower means (30–32;28) at a distance from the mouth of the casing tube (11) at least substantially equal to the distance defined by the form-restricted axial movability between the guide member (10) and the drill bit (20).

7. A drilling tool according to claim 3 with the guide member (10) thereof being rotatably centered in coaxial relation to the drilling axis (16) by a guide shoe (13) at the mouth of the casing tube (11) and having axial abutments (15) thereon for transmitting during drilling impact power to both the casing tube (11) via an annular shoulder (14) on the casing shoe (13) and to the drill bit (20), said drilling tool being c h a r a c t e r i s e d b y the eccentric bit (22) during drilling being maintained at a distance from the mouth of the casing tube (11) at least substantially equal to the length of the pilot bit (23).

8. A drilling tool according to claim 1 wherein during drilling a transverse abutment (33) forwardly on the guide member (10) transmits rotation to the drill bit (20) via a mating transverse abutment (34) on the eccentric bit (22), one of said abutments (34) having a rounded surface (35) allowing angular disengagement of said abutments (33,34).

9. A drilling tool according to claim 4, wherein said cam follower (28) is a pin transversely disposed in said guide member (10) and extending into said bore (24) thereof for cooperation with said cam grooves (29–32) on said drill bit (20).

10. A drilling tool according to claim 2, wherein said cam means are cam grooves (30–32) on said shaft (21) comprising an axial groove (31) extending between peripherally disposed rear end front end grooves (30,32), the follower means being a cam follower (28) in said guide member (10) in cooperating engagement with said cam grooves (30–32).

* * * * *